US009849980B2

(12) United States Patent
Li

(10) Patent No.: US 9,849,980 B2
(45) Date of Patent: Dec. 26, 2017

(54) PERSONAL PROPULSION DEVICES WITH IMPROVED BALANCE

(71) Applicant: JLIP, LLC, Dania Beach, FL (US)

(72) Inventor: Raymond Li, Fort Lauderdale, FL (US)

( * ) Notice: Subject to any disclaimer, the term of this patent is extended or adjusted under 35 U.S.C. 154(b) by 0 days.

(21) Appl. No.: 14/210,102

(22) Filed: Mar. 13, 2014

(65) Prior Publication Data

US 2014/0263849 A1 Sep. 18, 2014

Related U.S. Application Data

(60) Provisional application No. 61/801,165, filed on Mar. 15, 2013.

(51) Int. Cl.

| | |
|---|---|
| ***B64C 39/02*** | (2006.01) |
| ***B63H 11/00*** | (2006.01) |
| ***B63H 11/113*** | (2006.01) |
| ***B63B 35/73*** | (2006.01) |
| ***B63H 11/04*** | (2006.01) |
| *B63B 35/79* | (2006.01) |

(52) U.S. Cl.

CPC ..... *B64C 39/026* (2013.01); *B63B 35/731* (2013.01); *B63H 11/04* (2013.01); *B63H 11/113* (2013.01); *B63B 35/7943* (2013.01); *B63H 11/00* (2013.01); *B63H 2011/006* (2013.01)

(58) Field of Classification Search

CPC ..... B64C 29/00; B64C 29/02; B64C 29/04; B64C 39/026; B64C 19/00; B64C 15/12; A63B 35/00; B63B 11/04; B63B 11/113; B63B 2011/006

See application file for complete search history.

(56) References Cited

U.S. PATENT DOCUMENTS

| | | | |
|---|---|---|---|
| 1,833,354 | A | 11/1931 | Bauer |
| 2,461,347 | A | 1/1949 | Pentecost |
| 2,509,603 | A | 4/1950 | Marin |
| 2,691,784 | A | 10/1954 | Eckl |
| 2,920,841 | A | 12/1959 | Junker |
| 2,943,816 | A | 7/1960 | Hiller, Jr. |
| 2,953,321 | A | 9/1960 | Robertson et al. |
| 3,021,095 | A | 1/1962 | Moore |

(Continued)

FOREIGN PATENT DOCUMENTS

JP 6-8888 1/1994

OTHER PUBLICATIONS

B. Lindenbaum—"VSTOL Concepts and Developed Aircraft, vol. 1—A Historical Report (1940-1986)", Issued by Flight Dynamics Laboratory on Dec. 29, 1986 in the United States. See Figure 2.2.2.2 and accompanying written description at pp. 2-19 to 2-20.

(Continued)

*Primary Examiner* — Richard R Green
(74) *Attorney, Agent, or Firm* — Nicholas R. Lewis, Esq.

(57) ABSTRACT

A personal propulsion device, including a platform configured to support a passenger's body; and at least one fluid discharge nozzle coupled to the platform and angled with respect to the platform, where the angle defined between the nozzle and the platform is between approximately 95° and 120°; where the personal propulsion device is configured to receive pressurized fluid from a remote pressurized fluid source, and where the personal propulsion device is configured to achieve flight.

19 Claims, 3 Drawing Sheets

(56) References Cited

U.S. PATENT DOCUMENTS

| | | | | |
|---|---|---|---|---|
| 3,023,980 | A | 2/1962 | Martin | |
| 3,149,798 | A | 9/1964 | Moore | |
| 3,150,847 | A | 9/1964 | Moore | |
| 3,176,984 | A | 4/1965 | Sullivan | |
| 3,243,144 | A | 3/1966 | Hulbert | |
| 3,245,637 | A | 4/1966 | Eickmann | |
| 3,277,858 | A | 10/1966 | Athey | |
| 3,381,917 | A | 5/1968 | Moore | |
| 3,421,253 | A | 1/1969 | Thurston | |
| 3,443,775 | A | 5/1969 | William | |
| 3,474,987 | A | 10/1969 | Meditz | |
| 3,503,574 | A | 3/1970 | Eickmann | |
| 3,556,438 | A | 1/1971 | Meditz | |
| 3,570,785 | A | 3/1971 | Croft et al. | |
| 3,586,263 | A | 6/1971 | Payne | |
| 3,614,024 | A | 10/1971 | Millman | |
| 3,700,172 | A * | 10/1972 | Gallegos, Sr. | 244/12.2 |
| 4,040,577 | A | 8/1977 | Moore | |
| 4,348,976 | A | 9/1982 | Gilbert | |
| 4,417,706 | A | 11/1983 | Miller | |
| 4,447,024 | A | 5/1984 | Williams | |
| 4,541,357 | A | 9/1985 | Stanton | |
| 4,738,212 | A | 4/1988 | Schweitzer | |
| 5,419,514 | A * | 5/1995 | Ducan | 244/23 B |
| 5,679,035 | A | 10/1997 | Jordan | |
| 5,779,188 | A | 7/1998 | Frick | |
| 6,299,494 | B1 * | 10/2001 | Bowers | B63H 11/113 440/42 |
| 6,488,232 | B2 | 12/2002 | Moshier | |
| 6,951,322 | B2 | 10/2005 | Klima | |
| 7,249,732 | B2 | 7/2007 | Sanders, Jr. | |
| 7,258,301 | B2 * | 8/2007 | Li | 244/4 A |
| 7,581,608 | B2 | 9/2009 | St. Louis | |
| 7,614,355 | B2 | 11/2009 | Zeyger | |
| 7,735,772 | B2 | 6/2010 | Li | |
| 7,900,867 | B2 | 3/2011 | Li | |
| 8,336,805 | B1 * | 12/2012 | Zapata | 244/4 A |
| 8,449,340 | B1 * | 5/2013 | Zeyger | B63B 1/16 114/55.56 |
| 8,608,104 | B2 | 12/2013 | Zapata | |
| 9,145,206 | B1 | 9/2015 | Robinson | |
| 2008/0014811 | A1 * | 1/2008 | Zeyger | 441/66 |
| 2009/0325430 | A1 * | 12/2009 | Erriu | 440/40 |
| 2014/0216319 | A1 * | 8/2014 | Frisky | 114/55.5 |

OTHER PUBLICATIONS

Robert D. Roach, Jr.—"Bell's engineer-pilots are bringing man closer to Personal Rocket Flight," article in publication Machine Design in Dec. 1964 in the United States.

Bell Aerosystems Company—"Small Rocket Lift Device Phase I Design, Fabrication, and Static Testing," Technical report published on Dec. 27, 1978 in the United States.

Zimmerman, C.H., et al.—"Preliminary Experimental Investigation of the Flight of a person supported by a Jet Thrust Device Attached to His Feet," research memorandum published on Jan. 15, 1953. See description on pp. 2-9 and illustrations on pp. 20-31.

Carr, John C., unnamed illustrations, published in the United States as early as Dec. 31, 1969.

Author unknown, screen shot of the silent film "Duck Soup," published in the United States in 1927. The full video can be viewed at http://youtu.be/Bvchc4XYBYQ?t=21m8s.

Author unknown, screen shot of the cartoon film "Mickey's Fire Brigade," published in the United States in 1935 The full video can be viewed at https://www.youtube.com/watch?v=kSfyFytXrR8.

author unknown, printed instruction booklet for the video game "Super Mario Sunshine," published in the United States as early as Dec. 31, 2002. See device images at pp. 24-25.

USPTO Corrected Filing Receipt for U.S. Appl. No. 14/066,997 (U.S. Pat. No. 9,145,206), dated Aug. 30, 2016.

* cited by examiner

*FIG. 1 – PRIOR ART*

PERSONAL PROPULSION DEVICES WITH IMPROVED BALANCE

CROSS-REFERENCE TO RELATED APPLICATION

This application is related to and claims priority to U.S. Provisional Patent Application Ser. No. 61/801,165, filed Mar. 15, 2013, entitled "Personal Propulsion Devices with Improved Balance," the entirety of which is incorporated herein by reference.

STATEMENT REGARDING FEDERALLY SPONSORED RESEARCH OR DEVELOPMENT n/a

FIELD OF THE INVENTION

The present invention relates to personal propulsion devices and methods of use thereof.

BACKGROUND OF THE INVENTION

A number of water propelled, personal flight devices have recently become available. One such device is disclosed in U.S. Pat. No. 8,336,805. The device 10, shown in FIG. 1, includes a platform 12 for a passenger to stand upon, and two nozzles 14*a*, 14*b* immovably fixed under and perpendicular to the platform 12. The two nozzles discharge pressurized fluid to elevate the device 10 for flight. Operation of the device in the '805 patent requires balancing the weight and resulting forces of the passenger's body about the platform 12, and more specifically, about an axis 16 running horizontally through the nozzles. Such balancing may require extremely frequent yet delicate dorsiflexion and planarflexion of the passenger's leg muscles, which could lead to muscle fatigue for the passenger. In addition, should the passenger tilt and start to lose balance, it may be difficult for some passengers to counteract the tilting moment as the tilt angle increases, resulting in unwanted falling. The present disclosure provides personal propulsion devices with improved and selectively adjustable balance and weight distribution features and methods of use thereof.

SUMMARY OF THE INVENTION

The present disclosure advantageously provides a personal propulsion device, including a platform configured to support a passenger's body; and at least one fluid discharge nozzle coupled to the platform and angled with respect to the platform, where the angle defined between the nozzle and the platform is between approximately 95° and 120°; where the personal propulsion device is configured to receive pressurized fluid from a remote pressurized fluid source, and wherein the personal propulsion device is configured to achieve flight. The at least one fluid discharged nozzle may define an angle with respect to the platform in two different planes and/or the at least one fluid discharged nozzle may defines an angle with respect to the platform that is between approximately 95° and 120° in a first plane, and the at least one fluid discharged nozzle may define an angle with respect to the platform that is between approximately 95° and 120° in a second plane substantially perpendicular to the first plane. The personal propulsion device may include two nozzles or four nozzles angled with respect to the platform, where the angle defined between each nozzle and the platform is between approximately 95° and 120°. The platform may include at least two segments that are independently pivotable with respect to each other, the platform may be located above the at least one nozzle, and/or the platform may be located below the at least one nozzle. The angle defined between the nozzle and the platform may be selectively adjustable between approximately 95° and 120°. A length of the at least one fluid discharge nozzle may be selectively adjustable and/or may include a telescoping mechanism allowing selective adjustment of the nozzle length. The remote pressurized fluid source may include a personal watercraft.

A personal propulsion device is disclosed, including a passenger assembly adapted to support a passenger's body; and at least one nozzle movably coupled to the passenger assembly, where an angle defined between the nozzle and the passenger assembly is selectively adjustable; and where the personal propulsion device is configured to receive pressurized fluid from a remote pressurized fluid source to achieve flight. The at least one nozzle may be movable about a plurality of axes, may be movably coupled to the passenger assembly by a joint having at least 3 degrees-of-freedom, and/or may be movably coupled to the passenger assembly by a ball-and-socket joint. The passenger assembly may include a platform having at least two segments that are independently pivotable with respect to each other.

A method of operating a personal propulsion device is disclosed, including connecting a personal propulsion device to a pressurized fluid source, where the personal propulsion device includes a platform configured to support a passenger's body, and at least one fluid discharge nozzle beneath the platform and angled with respect to the platform, where the angle defined between the nozzle and the platform is between approximately 95° and 120°; and delivering pressurized fluid from the pressurized fluid source to the at least one fluid discharge nozzle to elevate the personal propulsion device while the pressurized fluid source does not elevate. The method may include adjusting the delivery of pressurized fluid from a throttle on the personal propulsion device. The pressurized fluid source may include a personal watercraft.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
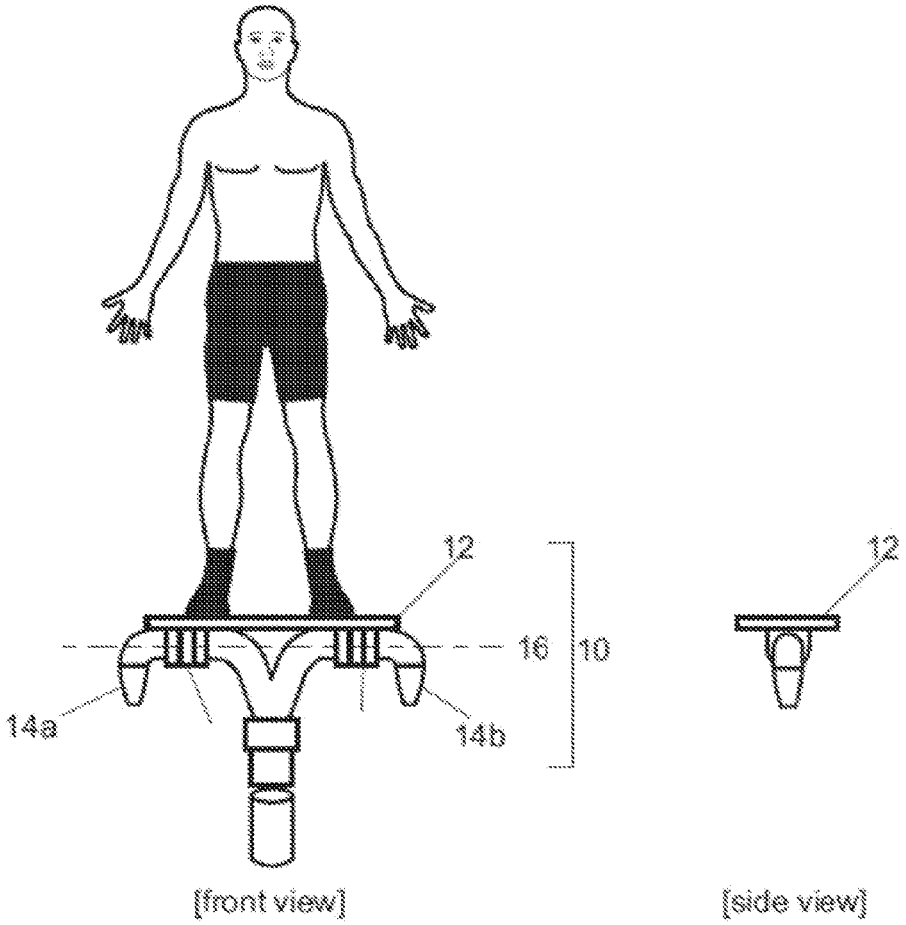
FIG. 1 is an illustration of a personal propulsion device of the prior art.

The present disclosure provides personal propulsion devices and methods of use thereof with improved balance and weight distribution characteristics. Now referring to FIG. 2, an example of a personal propulsion device 20 configured in accordance with principles of the present disclosure is shown. In general, the personal propulsion device 20 supports or otherwise attaches to a user/passenger and employs pressurized fluid to propel a passenger and the device into the air or otherwise as the passenger directs (e.g., submerged through a body of water, along the surface of a body of water, etc.).

The device 20 includes a passenger assembly for supporting a passenger's body. The passenger assembly may include, for example, a platform 22 that a passenger can stand on. The passenger assembly may include one or more fasteners or mounting components such as boots, straps, or the like to secure one or more portions of a person's body to the passenger assembly, and thus the device 20. The platform 22 may include one or more substantially planar segments, and/or may include one or more portions or segments 22*a*, 22*b* that are independently rotatable or pivotable with respect to each other such that a passenger's feet may be moved independently of one another.

The device may further include one or more fluid discharge components that provide propulsion for the device 20. The fluid discharge components may provide sufficient thrust or force to elevate the passenger assembly of the device into the air. For example, the device 20 may include one or more nozzles 24*a*, 24*b*, 24*c*, 24*d* that provide thrust and/or propulsion by discharging a fluid outward. The nozzles may be joined by nozzle elbows 29*a* and 29*b* which are coupled to a supply tube 28 that supplies water or fluid to the nozzles. The device in FIG. 2 includes four nozzles, but contemplated examples may include virtually any number of nozzles.

The left nozzle elbows 29*a* and right nozzle elbows 29*b* may be fixably coupled to the platform 22. Nozzle elbows 29*a* and 29*b* may be rotatably coupled to supply tube 28, allowing supply tube to pivot freely up and down. In another example of the device 20, the left nozzle elbows 29*a* may be fixably coupled to independent platform segment 22*a* and right nozzle elbows 29*b* may be fixably coupled to independent platform segment 22*b*. When viewed from the front of the device, the nozzles (or an axis passing through the nozzles) may form an angle $\alpha$ with the platform 22 [or with left platform 22*a* and right platform 22*b* in the example where the device includes two independently movable platform segments] and/or an axis 26 passing through a width of the device about which the nozzles 24*b* and 24*d* may pivot or rotate (either in conjunction with or independently of pivoting or rotation of the platform segment(s)).

The angle $\alpha$ may be between approximately 95° and 120° (that is, between approximately 5° and 30° with respect to an axis perpendicular to the platform and/or pivoting axis of the nozzles). When viewed from the side of the device 20, the nozzles (or an axis passing through the nozzles) may form an angle $\beta$ with the platform 22 and/or an axis passing through the nozzle elbow of the device about which the nozzles may pivot or rotate (either in conjunction with or independently of pivoting or rotation of the platform). The angle $\beta$ may be between approximately 95° and 120° (that is, between 5° and 30° with respect to an axis perpendicular to the platform and/or pivoting axis of the nozzles). The nozzles do not point vertically down towards the ground, but have cant angles in front-to-back and/or side-to-side directions, e.g. the front left nozzle may have a cant angle to the left and towards the front, the front right nozzle may have a cant angle to the right and to the front, etc. The nozzles may include angled orientations in both front-back and side directions, or may be limited to one or the other.

The angles between the nozzles and the platform or axis may be selectively adjustable. For example, the nozzles may be movably coupled to the platform or other structures of the device 20 such that the nozzles can be pivoted, turned, rotated, or otherwise manipulated about one or more axes to provide a desired angled orientation with respect to the platform or axis on multiple planes. An example of the movably junction or joint between the nozzle and platform or device 20 may include a ball and socket joint 27 providing multiple degrees of freedom for adjustment. Once a desired nozzle position is selected, the position may be secured in place through one or more locking mechanisms, such as a set screw, clamp, pin, or the like. Aside from being manually adjustable, the nozzle orientation may be adjusted electronically and/or electromechanically through one or more servomotors or other actuatable mechanisms. The adjustment of the nozzles may be achieved through wireless remote control to allow selective adjustment of the nozzles angles during a training exercise, or to modify the flight and/or maneuverability characteristics of the device in real time during operation.

In addition and/or alternatively to an adjustable angled orientation of the nozzles, the length of the nozzles and/or nozzle elbows may also be selectively adjustable. The length of the nozzles and/or nozzle elbows moves the location of the thrust force generated by the nozzle, which in turn, changes the resulting force moment or torques generated about the user. The nozzles and/or nozzle elbows may include a telescoping feature or other adjustable segment to selectively increase or decrease the nozzles and/or nozzle elbows length. For beginners, the length of the fore-aft nozzles and/or nozzle elbows tubes may be increased substantially to enhance the stabilizing moments, while advanced users may desire a decreased length to provide more extreme moments for particular maneuvers.

Figure 2:
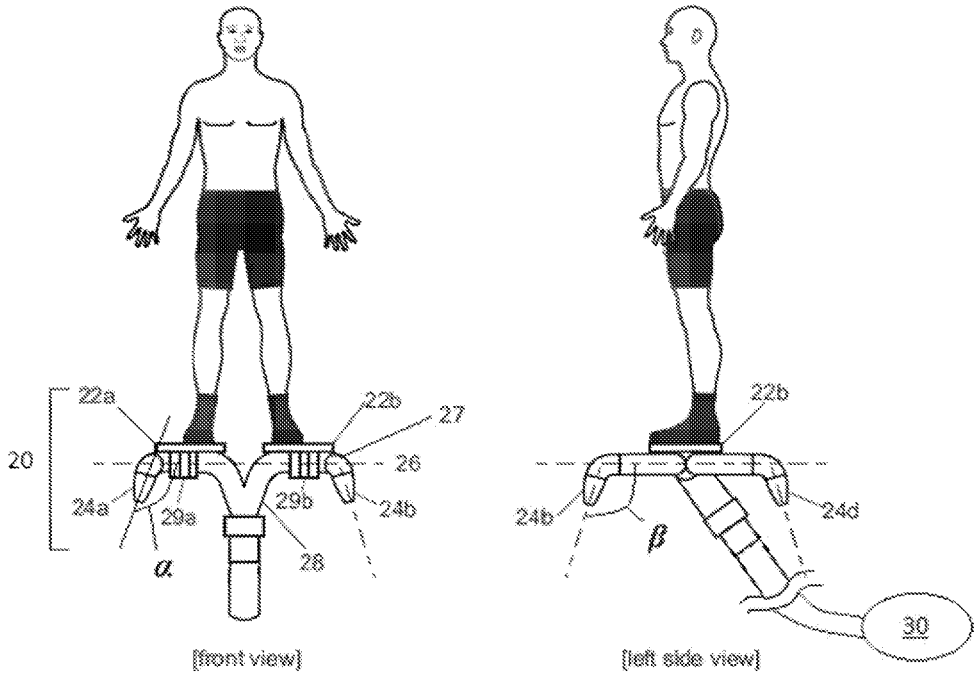
FIG. 2 is an illustration of an example of a personal propulsion device configured in accordance with the principles of the present disclosure.
Figure 3:
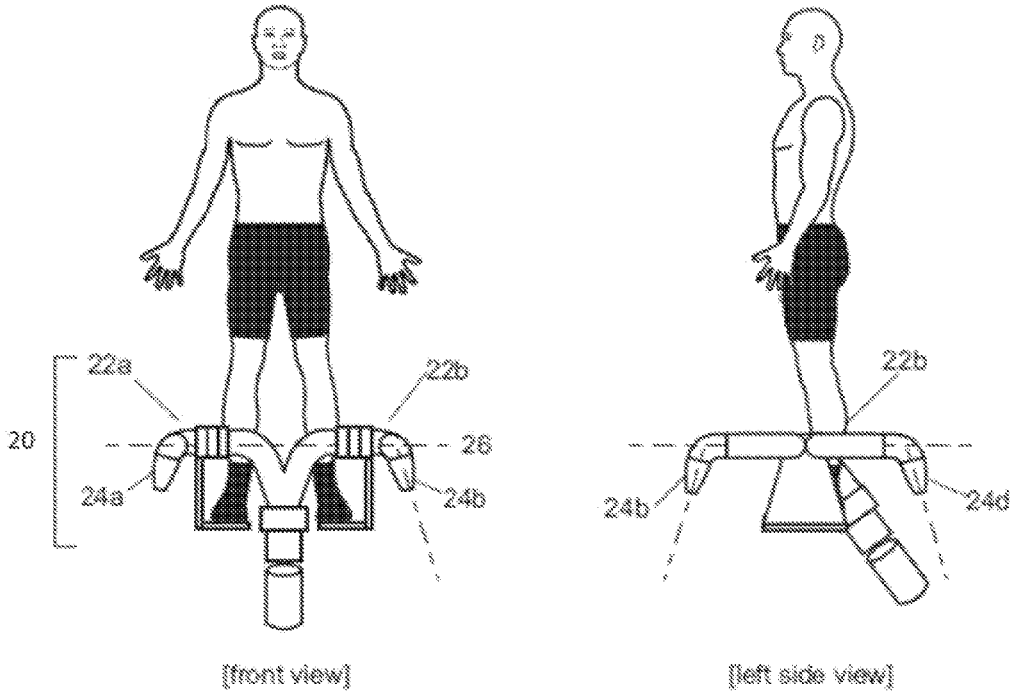
FIG. 3 is an illustration of another example of a personal propulsion device configured in accordance with the principles of the present disclosure.

The example in FIG. 2 shows the platform(s) located above the nozzles. In another example as shown in FIG. 3, the platform or assembly supporting the passenger may be located below the nozzles and pivotable about a point or axis located above the platform. For example, as shown in FIG. 3, the passenger's feet are coupled to the device with shoe-like bindings with their front soles mounted on rigid platforms below each pivotable nozzle elbow and fixably mounted to the nozzle assembly on each side, so that each nozzle assembly deflects independently relative to the supply tube 28 with passenger-induced movements of the binding platform.

Propulsion devices according to the present disclosure provide passenger balancing in a very different method which takes advantage of the very natural instinct of humans learning how to stand since a baby's age. The propulsion device incorporates cant angles on the nozzles to generate progressive resistance forces to pitch and roll movements of the device. For example, during normal hover, fore-aft nozzles with 25-degree cant angle on each side generate equal amounts of lift while the propulsion forces cancel each other out. As the device tilts forward, the forward nozzles on each side tilt downwards and the nozzle angle relative to the horizon becomes more and more vertical, generating a higher lift force vector and a lower propulsion force vector. In this example, the maximum lifting force from the forward nozzles is generated at 25 degrees forward, for the nozzles would then be vertical generating all lift and no propulsion vector. At the same time, the rear nozzles on each side tilt more towards horizontal, reducing the lifting force vector and increasing the propulsion vector. The passenger's feet thus encounter a significant and progressive reaction force at the toes, while the heels will feel lighter. The passenger could use planarflexion against this reaction force to right a tilting upper torso, while the propulsion force also pushes the feet forward under the passenger to improve balance.

The propulsion devices according to the present disclosure also offer another advantage by locating the foot binding platform below the nozzle pipes, lowering the device-passenger assembly's center of gravity relative to nozzle thrust, and allowing the passenger to stabilize against fore-aft torso movement by brazing his/her shins against the nozzle pipes (a shin guard may be worn). The flexible sole of the foot binding allows the passenger to raise his/her heels to dissipate energy with ligaments and muscles during landing. Furthermore, during extreme acrobatic maneuvers, being able to raise the heels allows more agility because the nozzle propulsion force can be directed at more extreme angles relative to the passenger's legs than if one was restricted by a stiff boot-like device.

Though the pivot point and location of the nozzles are shown in FIG. 3 to be located approximately at the shin of a passenger, the location may be extended upward so that a larger portion of the passenger's body is below the nozzles. For example, the nozzles may be located approximately at the middle of the torso.

The device may include or otherwise receive pressurized fluid from a separate, remote fluid pressurization source 30. The fluid pressurization source may include, for example, a personal watercraft having a pressurized fluid output, a compressor delivering pressurized fluid, and/or a watercraft having a sealed hull such as that disclosed in U.S. Pat. No. 7,258,301. Pressurized fluid may be delivered from the source 30 to the one or more nozzles of the device by a conduit, such as a large flexible hose or the like. The source 30 may remain grounded or otherwise not elevate in conjunction with the elevation of the device 20 during use. The device may include a throttle in communication with the source allowing a user or passenger in the device to modify or adjust the pressurized fluid delivery to the device from the source 30, thus allowing a user to control the resulting propulsion output of the device. Additional disclosure regarding personal propulsion devices with separate pressurized fluid sources can be found in U.S. Pat. Nos. 7,258,301 and 8,336,805, the entirety of all of which is expressly incorporated herein by reference.

It will be appreciated by persons skilled in the art that the present invention is not limited to what has been particularly shown and described herein above. In addition, unless mention was made above to the contrary, it should be noted that all of the accompanying drawings are not to scale. Of note, the system components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Moreover, while certain embodiments or figures described herein may illustrate features not expressly indicated on other figures or embodiments, it is understood that the features and components of the examples disclosed herein are not necessarily exclusive of each other and may be included in a variety of different combinations or configurations without departing from the scope and spirit of the invention. A variety of modifications and variations are possible in light of the above teachings without departing from the scope and spirit of the invention, which is limited only by the following claims.

What is claimed is:

1. A personal propulsion device, comprising:

a passenger assembly adapted to support a passenger's body, the passenger assembly including at least two segments that are independently pivotable with respect to each other, wherein each segment is configured to support a leg of the passenger's body; and at least one nozzle movably coupled to the passenger assembly, wherein the at least one nozzle defines an angle with respect to at least one of the two segments in two different planes and is configured to discharge fluid away from the passenger assembly to elevate the passenger assembly;

wherein the personal propulsion device is configured to receive pressurized fluid from a remote pressurized fluid source to achieve flight.

2. The device of claim 1, wherein the at least one nozzle defines an angle with respect to at least one of the two segments that is between approximately 95° and 120° in a first plane, and wherein the at least one nozzle defines an angle with respect to at least one of the two segments that is between approximately 95° and 120° in a second plane substantially perpendicular to the first plane.

3. The device of claim 1, wherein the personal propulsion device includes two nozzles angled with respect to at least one of the two segments, where the angle defined between each nozzle and the at least one of the two segments is between approximately 95° and 120°.

4. The device of claim 1, wherein the personal propulsion device includes four nozzles angled with respect to at least one of the two segments, where the angle defined between each nozzle and the at least one of the two segments is between approximately 95° and 120°.

5. The device of claim 1, wherein the at least two segments are located above the at least one nozzle.

6. The device of claim 1, wherein the at least two segments are located below the at least one nozzle.

7. The device of claim 1, wherein a length of the at least one nozzle is selectively adjustable.

8. The device of claim 7, wherein the at least one fluid discharge nozzle includes a telescoping mechanism allowing selective adjustment of the nozzle length.

9. The device of claim 1, wherein the remote pressurized fluid source is a personal watercraft.

10. The device of claim 1, wherein an angle defined between the nozzle and the passenger assembly is selectively adjustable.

11. The device of claim 10, wherein the angle defined between the nozzle and at least one of the two segments is selectively adjustable between approximately 95° and 120°.

12. The device of claim 10, wherein the at least one nozzle is movable about a plurality of axes with respect to the passenger assembly.

13. The device of claim 10, wherein the at least one nozzle is movably coupled to the passenger assembly by a joint having at least 3 degrees-of-freedom.

14. The device of claim 10, wherein the at least one nozzle is movably coupled to the passenger assembly by a ball-and-socket joint.

15. The device of claim 1, wherein the pressurized fluid is water.

16. The device of claim 15, further comprising a flexible hose coupled to the passenger assembly configured to connect to the remote pressurized fluid source.

17. The device of claim 16, wherein the at least one nozzle is configured to receive the pressurized fluid from the remote pressurized fluid source to generate thrust to directly lift the passenger assembly.

18. The device of claim 17, further comprising a throttle coupled to the passenger assembly configured to controllably modify the delivery of pressurized fluid from the remote pressurized fluid source.

19. The device of claim 1, further comprising at least one fastener coupled to each segment to secure a portion of a person's body to the segment.

* * * * *